US009637888B2

(12) United States Patent
Iwamoto et al.

(10) Patent No.: US 9,637,888 B2
(45) Date of Patent: May 2, 2017

(54) CONSTRUCTION EQUIPMENT

(71) Applicant: Hitachi Construction Machinery Co., Ltd., Tokyo (JP)

(72) Inventors: Yohei Iwamoto, Ibaraki (JP); Junya Kawamoto, Ibaraki (JP); Osamu Kokuryou, Ibaraki (JP); Hiroshi Tabeta, Ibaraki (JP); Yasuhiro Miyahara, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/773,843

(22) PCT Filed: Apr. 25, 2014

(86) PCT No.: PCT/JP2014/061705
§ 371 (c)(1),
(2) Date: Sep. 9, 2015

(87) PCT Pub. No.: WO2014/181708
PCT Pub. Date: Nov. 13, 2014

(65) Prior Publication Data

US 2016/0060840 A1 Mar. 3, 2016

(30) Foreign Application Priority Data

May 9, 2013 (JP) ..... 2013-099381

(51) Int. Cl.
*E02F 3/32* (2006.01)
*E02F 3/38* (2006.01)
(Continued)

(52) U.S. Cl.
CPC ..... *E02F 3/325* (2013.01); *E02F 3/32* (2013.01); *E02F 3/384* (2013.01); *E02F 9/18* (2013.01); *E02F 9/2275* (2013.01)

(58) Field of Classification Search
CPC ... E02F 3/325; E02F 3/32; E02F 3/384; E02F 9/2275; E02F 9/18
(Continued)

(56) References Cited

U.S. PATENT DOCUMENTS 3,777,824 A * 12/1973 Anderson ..... E02F 9/2275 172/452
4,304,077 A * 12/1981 Muller ..... E02F 3/36 248/68.1
(Continued)

FOREIGN PATENT DOCUMENTS

EP 0 383 276 A1 8/1990
EP 1 462 576 A2 9/2004
(Continued)

*Primary Examiner* — Scott Lowe
(74) *Attorney, Agent, or Firm* — Crowell & Moring LLP

(57) ABSTRACT

A compact excavator includes: a swing post which is attached to a upperstructure and which can swing in a left/right direction, a working device which is attached to the swing post and which includes a boom cylinder, a counterweight, and hydraulic hoses which extend upwards between opposite side plates of the swing post, and through which pressure oil for driving the boom cylinder of the working device is guided. The compact excavator further includes a guide plate which is provided in the swing post, and which guides the hydraulic hoses downwards while restricting the hydraulic hoses from moving to approach a handrail when the hydraulic hoses attempt to expand toward the handrail due to driving of the working device.

5 Claims, 10 Drawing Sheets

(51) Int. Cl.
*E02F 9/18* (2006.01)
*E02F 9/22* (2006.01)

(58) Field of Classification Search
USPC ..... 414/918
See application file for complete search history.

(56) References Cited

U.S. PATENT DOCUMENTS

| | | | | |
|---|---|---|---|---|
| 5,108,253 | A | 4/1992 | Kobayashi et al. | |
| 2002/0174573 | A1* | 11/2002 | Ichikawa ..... | E02F 3/32 37/348 |

FOREIGN PATENT DOCUMENTS

| | | | |
|---|---|---|---|
| JP | 2-109851 | U | 9/1990 |
| JP | 5-81355 | U | 11/1993 |
| JP | 2001-254395 | A | 9/2001 |
| JP | 2004-176312 | A | 6/2004 |
| JP | 2005-344301 | A | 12/2005 |
| JP | 2005-344429 | A | 12/2005 |
| JP | 2009-215701 | A | 9/2009 |
| JP | 2011-169044 | A | 9/2011 |
| JP | 2012-017601 | A | 1/2012 |

* cited by examiner

CONSTRUCTION EQUIPMENT

TECHNICAL FIELD

The invention relates to a construction machine such as a hydraulic excavator which is provided with a swing post mounted with a working device and swinging in a left/right direction, and a hydraulic hose extending upwards between a pair of side plates of the swing post.

BACKGROUND ART

As this kind of background-art technique, there is a technique disclosed in Patent Literature 1. The background-art technique is a hydraulic excavator such as a compact excavator. The compact excavator is provided with a travel base, an upperstructure, a boom swing bracket, a working device and a counterweight. The travel base and the upperstructure constitute a body. The boom swing bracket, i.e. a swing post, is disposed in a position on a front side of a swing frame of the upperstructure and can swing in a left/right direction. The working device is attached to the boom swing bracket and includes hydraulic cylinders. The counterweight is disposed in a rear part of the swing frame of the upperstructure to secure weight balance with the working device. An operator's seat is disposed on the swing frame of the upperstructure. A handrail constituting a structure is disposed in a position on a front face of the upperstructure, i.e. in a position in front of the operator's seat. In addition, there are provided a pair of shafts, i.e. an upper shaft and a lower shaft which are disposed respectively in an upper side and a lower side with a space therebetween and extend vertically to connect the boom swing bracket to the swing frame of the upperstructure forming the body. A boom forming the working device and a boom cylinder are attached to the boom swing bracket.

In addition, the background-art technique is provided with a plurality of hydraulic hoses. The hydraulic hoses pass through the aforementioned space formed between the pair of shafts, and extend upwards so as to pass between a pair of opposite side plates of the boom swing bracket. Pressure oil for driving the hydraulic cylinders such as the boom cylinder, an arm cylinder, etc. included in the working device is guided through the hydraulic hoses. The hydraulic hoses are mounted in hose clamps to be retained thereby in the boom swing bracket. The hose clamps are attached to a wall plate to which a pair of side plates are fixed.

CITATION LIST

Patent Literature

Patent Literature 1: JP-A-2001-254395

SUMMARY OF INVENTION

Technical Problem

In the aforementioned background-art technique, when the boom swing bracket approaches the structure such as the handrail disposed in the position on the front face of the upperstructure, there is a fear that expansion sections of the hydraulic hoses may interfere with the handrail when the boom of the working device is raised. Accordingly, in the background-art technique, there is a tendency that the boom swing bracket is connected to the swing frame in a front-side position distant from the handrail so that the hydraulic hoses can be prevented from interfering with the handrail when the boom is raised.

In addition, when the boom swing bracket is disposed thus, a distance between the center line of rotation of the upper structure and a distal end of the working device, i.e. the reach, in the condition that the boom, an arm and a bucket belonging to the working device have been, for example, extended horizontally becomes long. Accordingly, the moment during work becomes so large that it is necessary to provide a heavy counterweight corresponding to such a large moment.

Thus, according to the background-art technique, reduction in the size and weight of the construction machine is apt to be restricted by the point that the boom swing bracket, i.e. the swing post, is provided in a position distant from the structure disposed in the position on the front face of the upper structure, i.e. the body, and by the point that it is necessary to provide a heavy counterweight. Incidentally, in a compact excavator, there is particularly a demand for miniaturization achieved by reduction in the weight of the counterweight.

The invention has been accomplished in consideration of the actual situation in the aforementioned background-art technique. An object of the invention is to provide a construction machine in which a swing post is allowed to be arranged close to a structure disposed in a position on a front face of a body without causing interference between an expansion section of a hydraulic hose and the structure disposed in the position on the front face of the body.

Solution to Problem

In order to achieve the object, according to the invention, there is provided a construction machine including: a body; a swing post which is attached to the body and which can swing a left/right direction; a working device which is attached to the swing post and which includes a hydraulic cylinder; a counterweight which is disposed in a rear part of the body to secure weight balance with the working device; and a hydraulic hose which extends upwards between a pair of opposite side plates of the swing post and through which pressure oil for driving the hydraulic cylinder of the working device is guided; wherein: the construction machine further includes a first guide portion which is provided in the swing post and which guides the hydraulic hose downwards while restricting the hydraulic hose from moving to approach a structure disposed in a position on a front face of the body when the hydraulic hose attempts to expand toward the structure due to driving of the working device.

According to the invention configured thus, the hydraulic hose can be restricted by the first guide portion so as not to move to approach the structure disposed in the position on the front face of the body when the hydraulic hose is expanded toward the structure. On this occasion, the hydraulic hose is guided downwards by the first guide portion and retained to reduce the shape of an expansion section of the hydraulic hose. Thus, the invention can surely prevent the hydraulic hose and the structure from interfering with each other. Accordingly, the invention can allow the swing post to be arranged close to the structure disposed in the position on the front face of the body. In accordance with this, the invention can shorten the distance between the center of the body and a distal end of the working device, reduce the moment during work, and lighten the weight of the counterweight correspondingly.

According to the invention, there is provided the aforementioned configuration, wherein: the first guide portion includes a guide plate which has a flat plate portion and an inclined plate portion, the flat plate portion being attached to the swing post, the inclined plate portion being provided to stand on the flat plate portion, having a face part disposed to face an expansion section of the hydraulic hose, and being formed to approach the structure as it goes upwards.

According to the invention configured thus, when the expanded hydraulic hose has made contact with the face part of the inclined plate portion of the guide plate, the inclined plate portion of the guide plate can not only restrict the hydraulic hose from moving to approach the structure disposed in the position on the front face of the body but also guide the expanded hydraulic hose downward smoothly in accordance with an inclination angle of the inclined plate portion. In addition, the expanded hydraulic hose has high rigidity and gives large pressing force to the inclined plate portion. On the other hand, it is possible to secure a large area in a contact section of the inclined plate portion with which the hydraulic hose comes in contact on this occasion. Accordingly, contact surface pressure of the hydraulic hose against the inclined plate portion can be suppressed to be low. Thus, the hydraulic hose making contact with the guide plate can be prevented from being worn.

According to the invention, there is provided the aforementioned configuration, wherein: the hydraulic cylinder of the working device includes a specified oil hydraulic cylinder which has one end connected to the swing post; and there is provided a second guide portion which is provided in the swing post and which guides the hydraulic hose downwards while restricting the hydraulic hose from moving to approach the specified oil hydraulic cylinder when the hydraulic hose attempts to expand toward the specified oil hydraulic cylinder due to driving of the working device.

According to the invention configured thus, the second guide portion can restrict the hydraulic hose from moving to approach the specified oil hydraulic cylinder when the hydraulic hose is expanded toward the specified oil hydraulic cylinder during work with the driven working device. On this occasion, the hydraulic hose can be guided downward by the second guide portion and retained to reduce the shape of an expansion section of the hydraulic hose. Accordingly, it is possible to surely prevent the hydraulic hose and the specified oil hydraulic cylinder from interfering with each other.

According to the invention, there is the aforementioned configuration, wherein: the second guide portion includes a rod which extends in the left/right direction perpendicular to an extension direction of the hydraulic hose, or a plate member which has a face part disposed to face an expansion section of the hydraulic hose.

According to the invention configured thus, when the second guide portion includes the rod, the second guide portion can be formed into a simple structure, which is rich in practicability and contributes to reduction of manufacturing cost. In addition, when the second guide portion includes the plate member, contact surface pressure of the hydraulic hose making contact with the second guide portion can be suppressed to be so low that the hydraulic hose can be prevented from being worn.

According to the invention, there is provided the aforementioned configuration, wherein: the construction machine consists of a compact excavator which includes a travel base, an upperstructure, an operator's seat, and a handrail, the travel base and the upperstructure constituting the body, the operator's seat being provided on a swing frame of the upperstructure, the handrail being disposed in a position on a front side of the operator's seat and forming the structure; the swing post is attached to a position on a front side of the swing frame of the upperstructure; the working device includes a boom which is connected to the swing post; and the specified oil hydraulic cylinder includes a boom cylinder driving the boom.

According to the invention configured thus, it is possible to allow the swing post to be arranged close to the handrail disposed in the position on the front side of the operator's seat without causing interference between an expansion section of the hydraulic hose and the handrail. Thus, it is possible to lighten the weight of the counterweight so that it is possible to reduce the size of the compact excavator.

Advantageous Effects of Invention

The invention has a configuration including the first guide portion which is provided in the swing post and which guides the hydraulic hose downwards while restricting the hydraulic hose from moving to approach the structure disposed in the position on the front face of the body when the hydraulic hose attempts to expand toward the structure due to driving of the working device. Accordingly, the swing post is allowed to be arranged close to the structure disposed in the position on the front face of the body without causing interference between the expansion section of the hydraulic hose and the structure disposed in the position on the front face of the body. Thus, according to the invention, in comparison with the background art, a distance between the center of the body and a distal end of the working device, i.e. the reach, when the working device has been extended horizontally can be shortened. It is therefore possible to suppress the moment during work to be small. In accordance with this, the weight of the counterweight can be reduced in comparison with the background art. Thus, the invention can achieve reduction in the size and weight of the construction machine, which would be difficult in the background art.

DESCRIPTION OF EMBODIMENT

Embodiments of a construction machine according to the invention will be described below with reference to the drawings.

Figure 1:
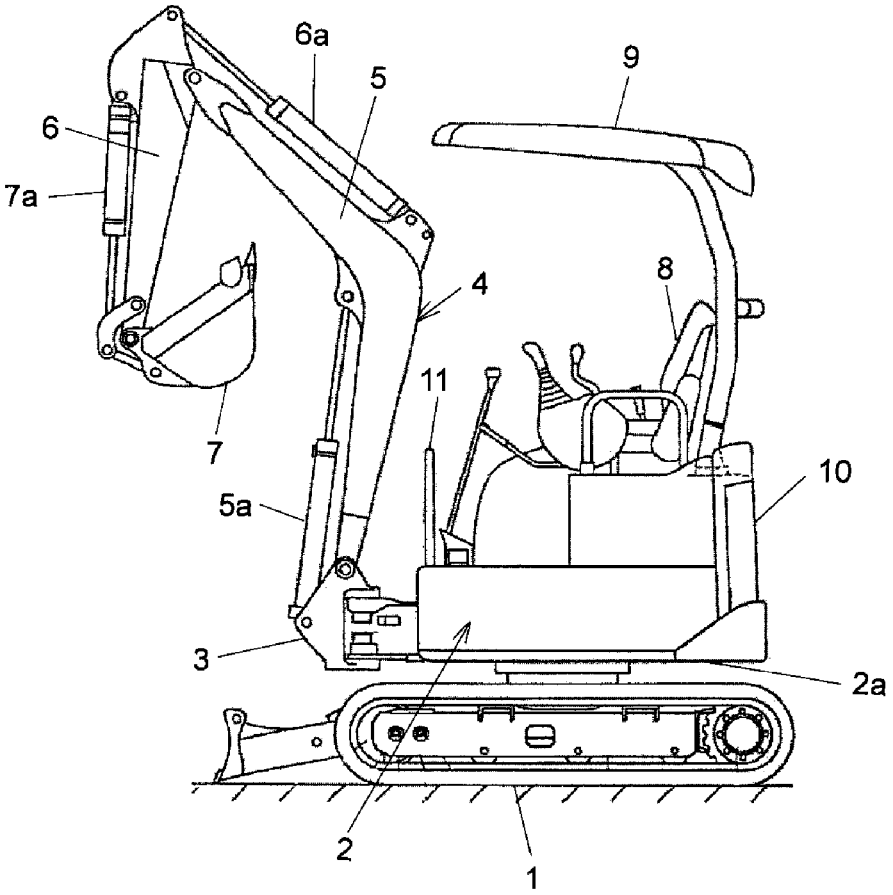
FIG. 1 A side view showing a compact excavator constituting a first embodiment of a construction machine according to the invention.

A first embodiment of the construction machine according to the invention is, for example, a compact excavator constituting a small-sized machine. As shown in FIG. 1, the compact excavator is provided with a travel base 1 and an upper structure 2. The travel base 1 constitutes a body. The upperstructure 2 is disposed on the travel base 1. In addition, the compact excavator is provided with a swing post 3 and a working device 4. The swing post 3 is attached to a position on a front side of a swing frame 2*a* of the upperstructure 2 and can swing in a left/right direction. The working device 4 is attached to the swing post 3 rotatably in an up/down direction to perform soil excavation work etc.

The working device 4 includes a boom 5, an arm. 6 and a bucket 7. The boom 5 is attached to the swing post 3. The arm 6 is attached to a distal end of the boom 5. The bucket 7 is attached to a distal end of the arm 6. In addition, the working device 4 includes a plurality of hydraulic cylinders, i.e. a boom cylinder 5*a*, an arm cylinder 6*a* and a bucket cylinder 7*a*. The boom cylinder 5*a* drives the boom 4. The arm cylinder 6*a* drives the arm 6. The bucket arm 7*a* drives the bucket 7. The aforementioned boom cylinder 5*a* constitutes a specified oil hydraulic cylinder having one end connected to the swing post 3.

An operator's seat 8 is disposed on the swing frame 2*a* of the upperstructure 2, and a canopy 9 is provided to cover above the operator's seat 8. A counterweight 10 is disposed in a rear part of the operator's seat 8 to secure weight balance with the working device 4. A handrail 11 constituting a structure disposed in a position on a front face of the body, i.e. the upperstructure 2 is disposed in a position in front of the operator's seat 8 on the swing frame 2*a*.

Figure 2:
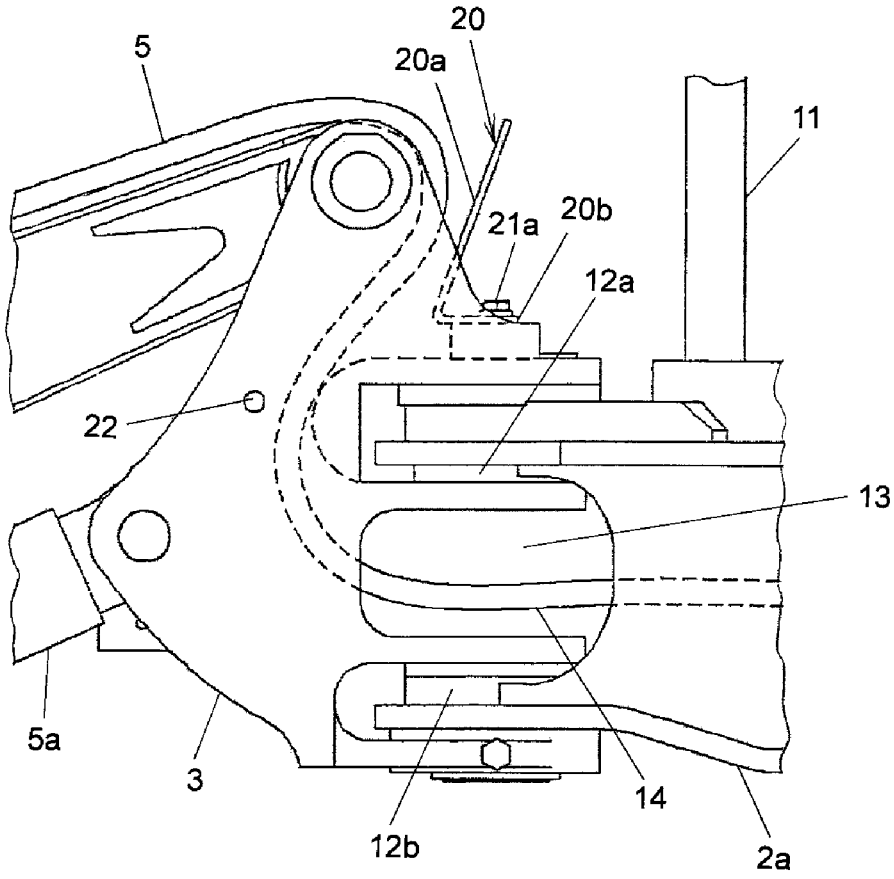
FIG. 2 A side view showing an enlarged swing post part provided in the first embodiment.
Figure 3:
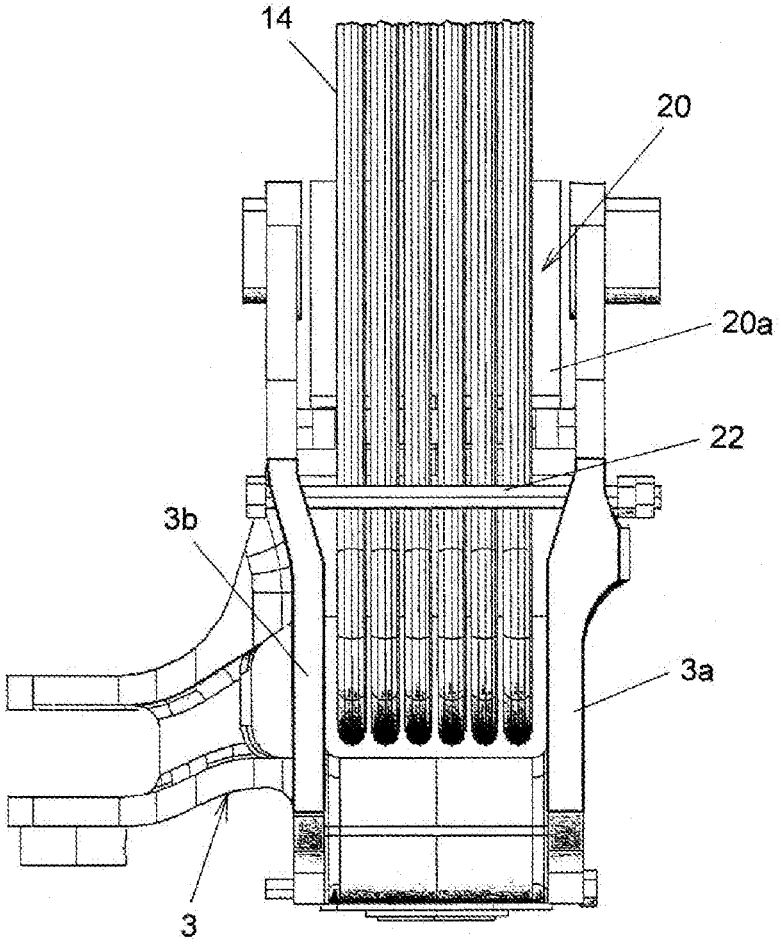
FIG. 3 A main part front sectional view of FIG. 2.

As shown in FIG. 2, the embodiment is provided with an upper shaft 12*a* and a lower shaft 12*b*. The upper shaft 12*a* and the lower shaft 12*b* are disposed in an upper side and a lower side with a space 13 therebetween and extend vertically to connect the swing post 3 and the swing frame 2 to each other. In addition, as shown in FIGS. 2 and 3, the embodiment is provided with a plurality of hydraulic hoses 14. The hydraulic hoses 14 pass through the space 13 between the upper shaft 12*a* and the lower shaft 12*b* and extend upwards between opposite side plates 3*a* and 3*b* of the swing post 3. Pressure oil for driving the aforementioned boom cylinder 5*a*, the aforementioned arm cylinder 6*a*, etc. is guided through the hydraulic hoses 14.

In addition, the embodiment is provided with a first guide portion. The first guide portion is provided in the swing post 3. When the hydraulic hoses 14 attempt to expand toward the structure e.g. the handrail 11 disposed in the position on the front face of the upperstructure 2 due to driving of the working device 4, the first guide portion guides the hydraulic hoses 14 downwards while restricting the hydraulic hoses 14 from moving to approach the handrail 11.

Figure 4:
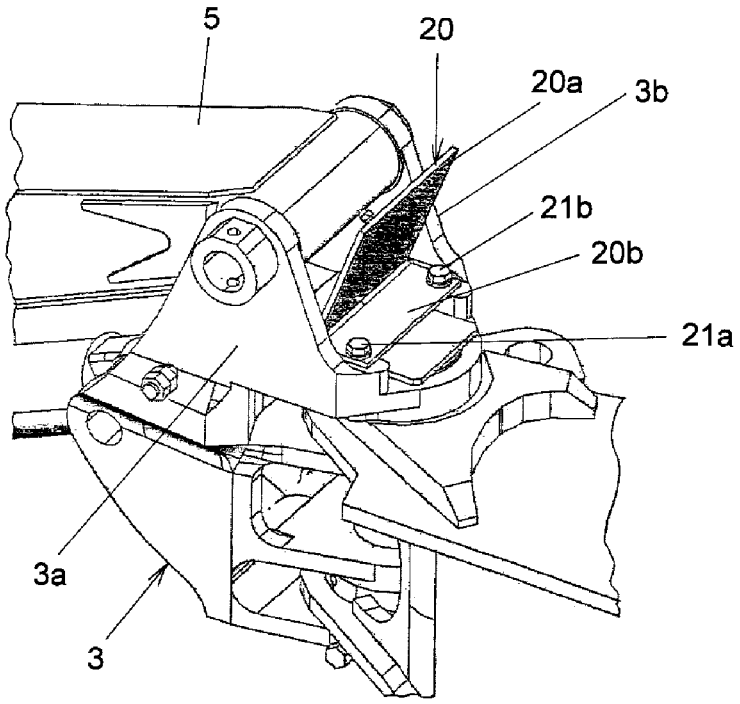
FIG. 4 A perspective view showing a guide plate part constituting a first guide portion provided in the first embodiment.
Figure 5:
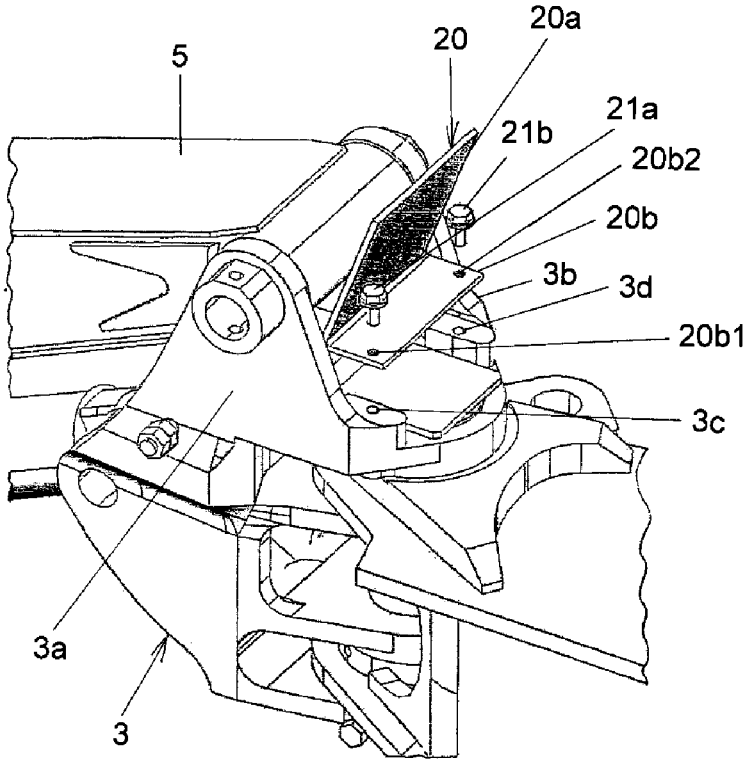
FIG. 5 An exploded perspective view showing the guide plate shown in FIG. 4.

The first guide portion includes a guide plate 20. As shown in FIGS. 2, 4, and 5, the guide plate 20 is provided with a flat plate portion 20*b*. The flat plate portion 20*b* has holes 20*b*1 and 20*b*2 which fit with threaded holes 3*c* and 3*d* formed in the swing post 3. The flat plate portion 20*b* is attached to the swing post 3 by bolts 21*a* and 21*b* which are inserted into these holes 20*b*1 and 20*b*2 and screwed down into the threaded holes 3*c* and 3*d* respectively. In addition, the guide plate 20 is provided with an inclined plate portion 20*a*. The inclined plate portion 20*a* is provided to stand on the flat plate portion 20*b*. The inclined plate portion 20*a* has a face part which is disposed to face expansion sections of the hydraulic hoses 14 expanded due to the driving of the work device 4. The inclined plate portion 20*a* is formed to approach the handrail 11 as it goes upwards.

As shown in FIGS. 2 and 3, the embodiment is further provided with a second guide portion, such as a rod 22. The rod 22 is provided in the swing post 3. When the hydraulic hoses 14 attempt to expand toward the aforementioned specified oil hydraulic cylinder, i.e. the boom cylinder 5*a* due to driving of the working device 4, the rod 22 guides the hydraulic hoses 14 downwards while restricting the hydraulic hoses 14 from moving to approach the boom cylinder 5*a*. The rod 22 is configured so that one end of the rod 22 can be inserted through the side plate 3*a* of the swing post 3 and the other end thereof can be inserted through the side plate 3*b*. The rod 22 extends in the left/direction direction which is perpendicular to an extension direction of the hydraulic hoses 14. The rod 22 is fixed to the side plates 3*a* and 3*b*.

Figure 6:
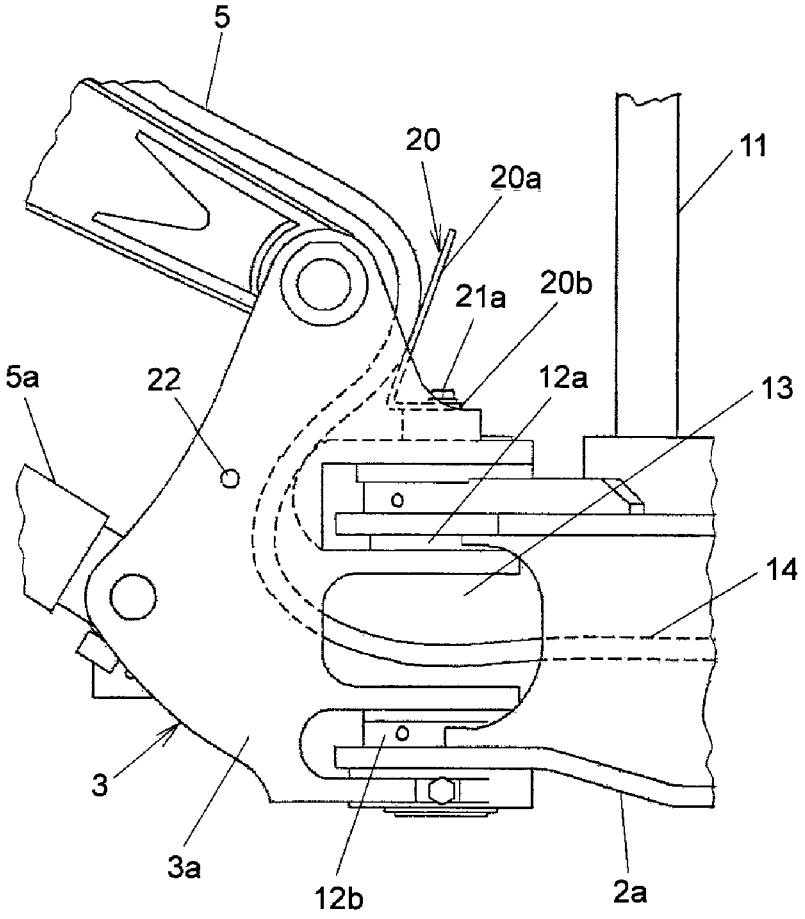
FIG. 6 A main part side view showing an operation of the first embodiment to show a state in which a boom has begun to be raised.

When, for example, the compact excavator according the embodiment having the aforementioned configuration raises the boom 5 of the working device 4 during work, the hydraulic hoses 14 expand toward the handrail 11 in the beginning, as shown in FIG. 6. Due to this expansion, expansion sections of the hydraulic hoses 14 abut against the inclined plate portion 20*a* of the guide plate 20. Accordingly, the hydraulic hoses 14 are restricted by the inclined plate portion 20*a* of the guide plate 20 so as not to approach the handrail 11 any further.

When the boom 5 is further raised, the hydraulic hoses 14 are guided downwards by the inclined plate portion 20*a* of the guide plate 20 while being restricted by the inclined plate portion 20*a* of the guide plate 20 so as not to move to approach the handrail 11.

Figure 7:
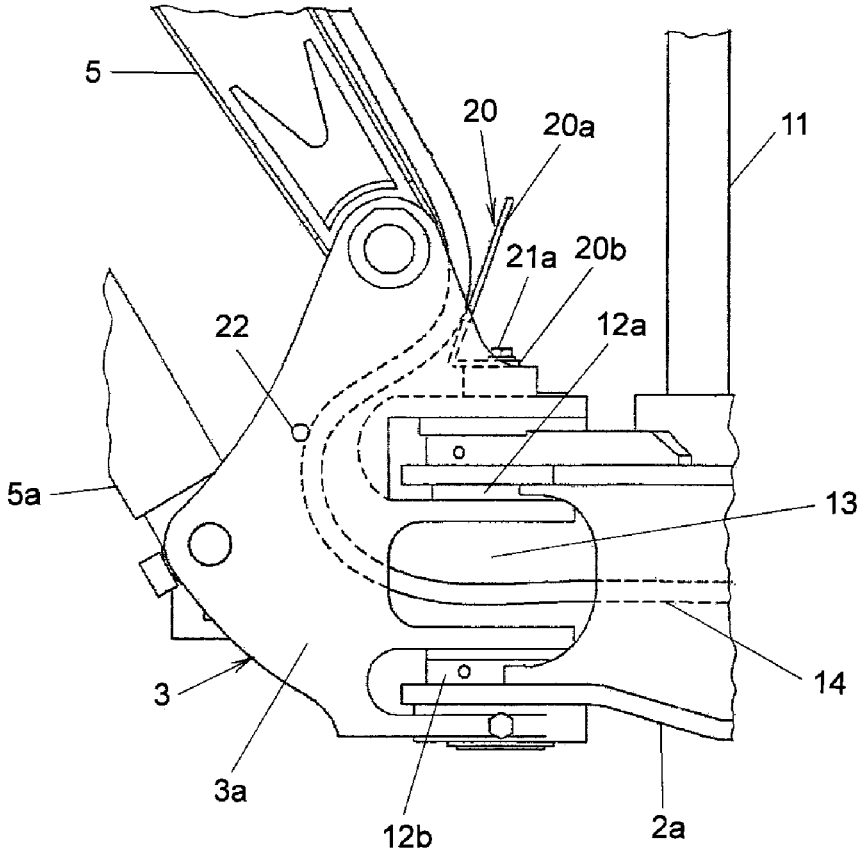
FIG. 7 A main part side view showing the operation of the first embodiment to show a state in which the boom has been further raised from the state shown in FIG. 6.

When the boom 5 is further raised, the hydraulic hoses 14 expand toward the boom cylinder 5*a* and the expansion sections of the hydraulic hoses 14 abut against the rod 22, as shown in FIG. 7. Accordingly, the hydraulic hoses 14 are restricted by the rod 22 so as not to approach the boom cylinder 5*a* any further.

Figure 8:
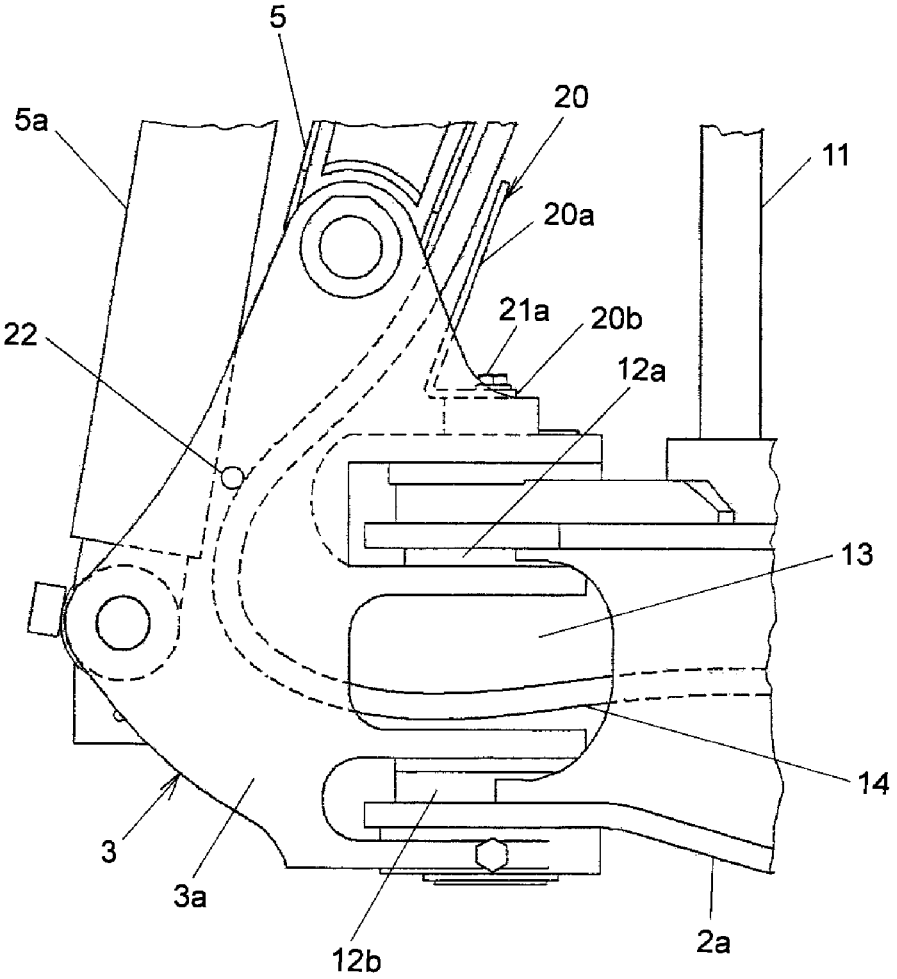
FIG. 8 A main part side view showing the operation of the first embodiment to show a state in which the boom has been raised to an uppermost position.

When the boom 5 is further raised, the hydraulic hoses 14 are guided downwards by the rod 22 while being restricted from moving to approach the rod 22. When the boom cylinder 5*a* has been raised to the utmost, the hydraulic hoses 14 are, for example, retained in a state shown in FIG. 8.

As described above, according to the embodiment, when the hydraulic hoses 14 are expanded toward the handrail 11, the hydraulic hoses 14 are restricted by the guide plate 20 so as not to move to approach the handrail 11. On this occasion, the hydraulic hoses 14 are guided downwards by the guide plate 20 and retained to reduce the shape of the expansion sections of the hydraulic hoses 14. Thus, according to the embodiment, it is possible to prevent the hydraulic hoses 14 and the handrail 11 from interfering with each other. Therefore, according to the embodiment, it is possible to allow the swing post 3 to be arranged close to the handrail 11 disposed in the position on the front face of the swing frame 2*a*. In accordance with this, the embodiment can shorten a distance between the center of the body (i.e. the center line of rotation of the upperstructure 2) and a distal end of the bucket 7 of the working device 4, i.e. the reach, when the boom 5, the arm 6 and the bucket 7 have been expanded horizontally. The embodiment can therefore suppress the moment during work to be small. Correspondingly to this, the embodiment can reduce the weight of the counterweight 10. Accordingly, the embodiment can achieve reduction in the size and weight of the compact excavator.

Moreover, in the embodiment, the first guide portion which guides the hydraulic hoses 14 downwards while restricting the hydraulic hoses 14 from moving to approach the handrail 11 includes the guide plate 20 having the inclined plate portion 20*a*. Accordingly, when the expanded hydraulic hoses 14 have made contact with the face part of the inclined plate portion 20*a* of the guide plate portion 20, the hydraulic hoses 14 can be restricted by the inclined plate portion 20*a* so as not to move to approach the handrail 11 while the expanded hydraulic hoses 14 can be guided smoothly downwards in accordance with the inclination angle of the inclined plate portion 20*a*. In addition, the expanded hydraulic hoses 14 have high rigidity and give large pressing force to the inclined plate portion 20*a*. On the other hand, it is possible to secure a large area in a contact section of the inclined plate portion 20*a* with which the hydraulic hoses 14 come in contact on this occasion. Accordingly, contact surface pressure of the hydraulic hoses 14 against the inclined plate portion 20*a* can be suppressed to be low. Thus, the hydraulic hoses 14 making contact with the guide plate 20 can be prevented from being worn.

In addition, the embodiment is provided with a second guide portion including the rod 22 which guides the hydraulic hoses 14 downwards while restricting the hydraulic hoses 14 from moving to approach the boom cylinder 5*a*. Accordingly, when the hydraulic hoses 14 are expanded toward the boom cylinder 5*a* during work with the driven working device 4, the hydraulic hoses 14 can be restricted by the rod 22 so as not to move to approach the boom cylinder 5*a* as described above. On this occasion, the hydraulic hoses 14 are guided downwards by the rod 22 and retained to reduce the shape of the expansion sections of the hydraulic hoses 14. Accordingly, the hydraulic hoses 14 and the boom cylinder 5*a* can be prevented surely from interfering with each other so that a highly reliable compact excavator can be achieved. In addition, the second guide portion can be formed into a simple structure, which is rich in practicability and contributes to reduction of manufacturing cost.

Figure 9:
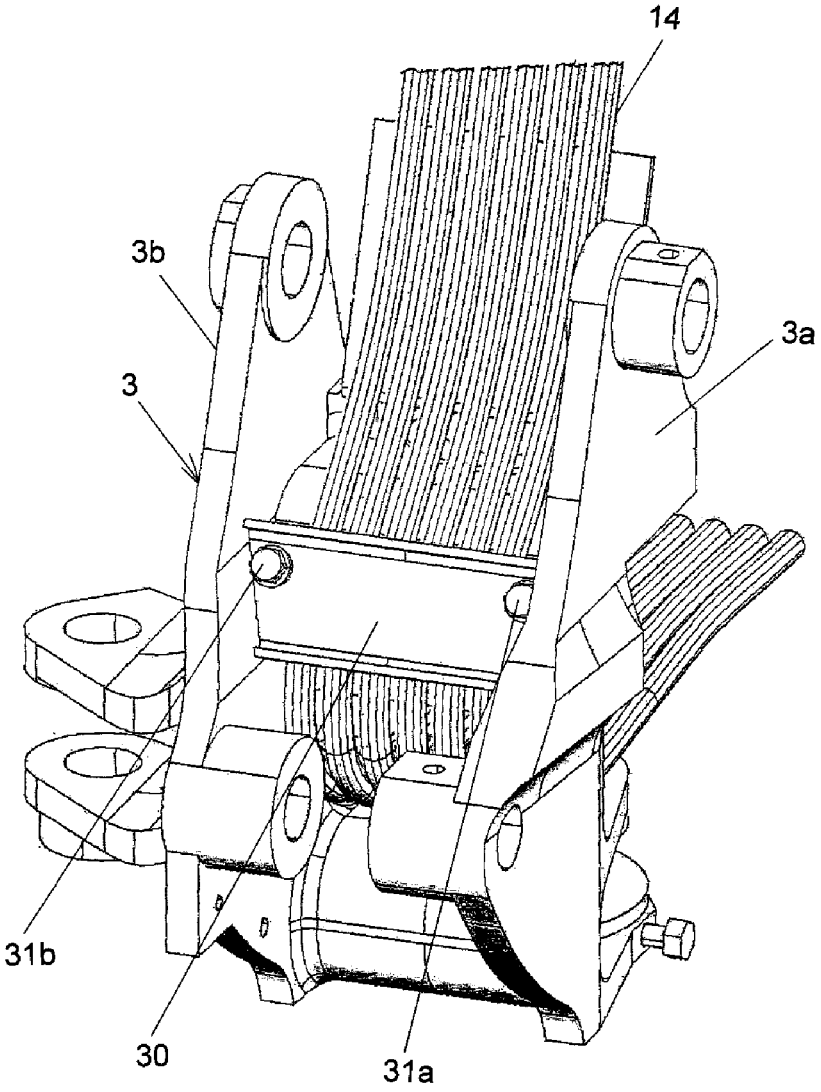
FIG. 9 A perspective view showing a main part configuration of a construction machine according to a second embodiment of the invention.
Figure 10:
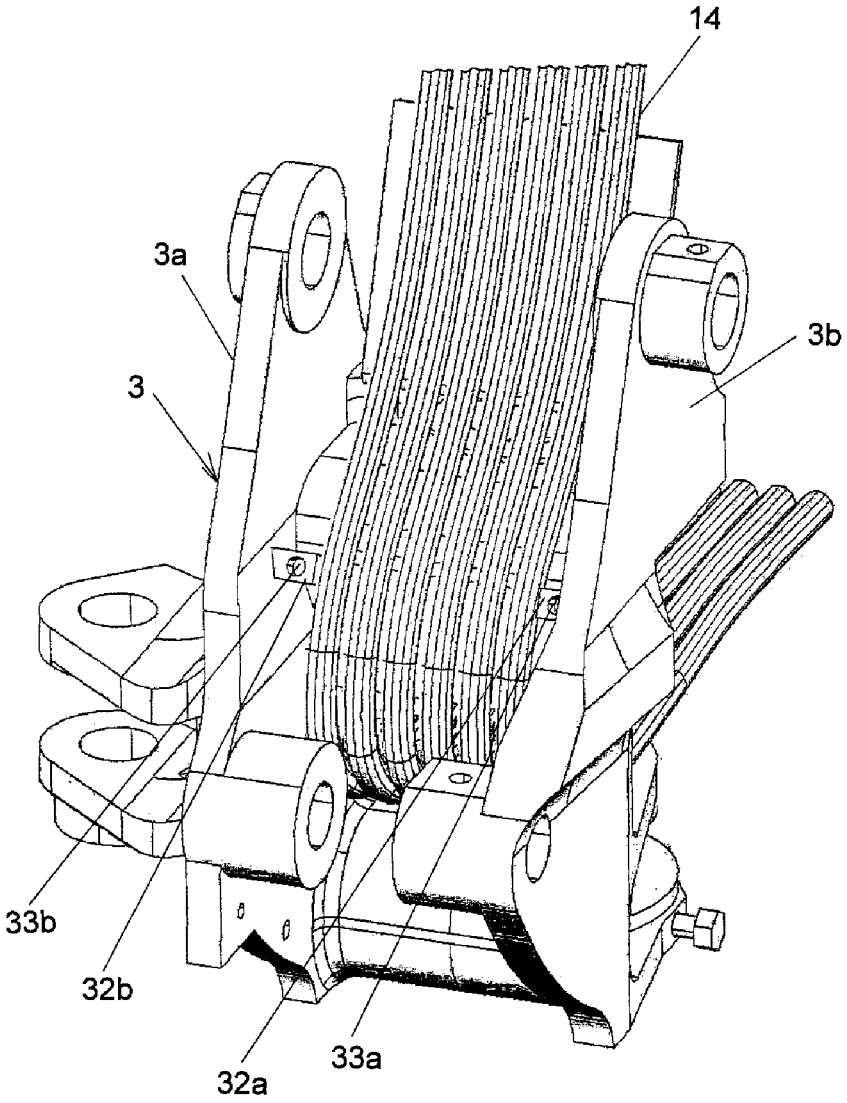
FIG. 10 A perspective view showing a state in which a guide plate constituting a second guide portion has been removed from the state shown in FIG. 9.

FIG. 9 is a perspective view showing a main part configuration of a construction machine according to a second embodiment of the invention. FIG. 10 is a perspective view showing a state in which a guide plate constituting a second guide portion has been removed from the state shown in FIG. 9.

The second embodiment of the invention shown in FIGS. 9 and 10 is different from the first embodiment in the configuration of the second guide portion which guides hydraulic hoses 14 downwards while restricting the hydraulic hoses 14 from moving to approach a boom cylinder 5*a*. For example, the second embodiment is the same compact excavator as that shown in FIG. 1, and the basic configuration, i.e. the configuration of the first guide portion etc. is equivalent to that in the first embodiment.

According to the second embodiment, the second guide portion includes a plate member 30 having a face part which is disposed to face expansion sections of the hydraulic hoses 14, as shown in FIG. 9. As shown in FIG. 10, brackets 32*a* and 32*b* having threaded holes 33*a* and 33*b* are fixed to the swing post 3 and the plate member 30 is fastened to the brackets 32*a* and 32*b* by bolts 31*a* and 31*b* which are screwed down into the threaded holes 3*a* and 33*b* of the brackets 32*a* and 32*b* respectively.

The second embodiment configured thus can also fundamentally obtain an equivalent function or effect to that in the aforementioned first embodiment. In addition, according to the second embodiment, the second guide portion includes the plate member 30. Accordingly, a large area in a contact section of the plate member 30 making contact with the expansion sections of the hydraulic hoses 14 can be secured so that contact surface pressure of the hydraulic hoses 14 against the plate member 30 can be suppressed to be low. Thus, the hydraulic hoses 14 making contact with the plate member 30 can be prevented from being worn.

REFERENCE SIGNS LIST

1 travel base (body)
2 upperstructure (body)
2*a* swing frame
3 swing post
3*a* side plate
3*b* side plate
4 working device
5 boom
5*a* boom cylinder (specified oil hydraulic cylinder)
6 arm
6*a* arm cylinder (hydraulic cylinder)
7 bucket
7*a* bucket cylinder (hydraulic cylinder)
8 operator's seat
10 counterweight
11 handrail (structure)
14 hydraulic hose
20 guide plate (first guide portion)
20*a* inclined plate portion
20*b* flat plate portion
22 rod (second guide)
30 plate member (second guide)

The invention claimed is:

1. A construction machine comprising:

a body;

a swing post which is attached to the body and which can swing a left/right direction;

a working device which is attached to the swing post and which includes a plurality of hydraulic cylinders and a boom;

a counterweight which is disposed in a rear part of the body to secure weight balance with the working device; and a hydraulic hose which extends upwards between a pair of opposite side plates of the swing post and through which pressure oil for driving one of the plurality of hydraulic cylinders of the working device is guided and which includes a first expansion section that is an upper side of the hydraulic hose and expands toward a structure disposed in a position on a front face of the body and a second expansion section that is a lower side of the hydraulic hose and expands toward a specified hydraulic cylinder among the plurality of hydraulic cylinders, which specified hydraulic cylinder has one end connected to the swing post, wherein a guide plate having an inclined plate portion is provided on the swing post, the guide plate is disposed between the structure and a portion where the boom is connected to the swing post, and the hydraulic hose is arranged between the guide plate and the portion where the boom is connected to the swing post, and the guide plate guides the hydraulic hose downwards by the inclined plate portion while restricting the hydraulic hose from moving to approach the structure disposed in the position on the front face of the body when the first expansion section of the hydraulic hose attempts to expand toward the structure due to driving of the working device.

2. A construction machine according to claim 1, wherein:

the guide plate further includes a flat plate portion attached to the swing post, the inclined plate portion is provided to stand on the flat plate portion and has a face part disposed to face the first expansion section of the hydraulic hose, and the inclined plate portion is formed to approach the structure as it goes upwards.

3. A construction machine according to claim 1, wherein:

the construction machine further comprises a guide portion which guides the hydraulic hose downwards while restricting the hydraulic hose from moving to approach the specified hydraulic cylinder when the second expansion section of the hydraulic hose attempts to expand toward the specified hydraulic cylinder due to driving of the working device.

4. A construction machine according to claim 3, wherein:

the guide portion includes a rod which extends in the left/right direction perpendicular to an extension direction of the hydraulic hose, or a plate member which has a face part disposed to face the second expansion section of the hydraulic hose.

5. A construction machine according to claim 1, wherein:

the construction machine consists of a compact excavator which comprises a travel base, an upperstructure, an operator's seat, and a handrail, the travel base and the upperstructure constituting the body, the operator's seat being provided on a swing frame of the upperstructure, the handrail being disposed in a position in front of the operator's seat and forming the structure;

the swing post is attached to a position on a front side of the swing frame of the upperstructure;

the working device includes a boom which is connected to the swing post; and the specified hydraulic cylinder includes a boom cylinder driving the boom.

* * * * *